US012215582B1

(12) United States Patent
Yao et al.

(10) Patent No.: US 12,215,582 B1
(45) Date of Patent: Feb. 4, 2025

(54) FRACTURING PUMP SPACER FRAME

(71) Applicant: YANTAI JEREH OILFIELD SERVICES GROUP CO., LTD., Shandong (CN)

(72) Inventors: Junlei Yao, Shandong (CN); Lianpan Duan, Shandong (CN); Feng Wang, Shandong (CN)

(73) Assignee: Yantai Jereh Oilfield Services Group Co., Ltd., Yantai (CN)

( * ) Notice: Subject to any disclaimer, the term of this patent is extended or adjusted under 35 U.S.C. 154(b) by 0 days.

(21) Appl. No.: 18/391,212

(22) Filed: Dec. 20, 2023

Related U.S. Application Data

(63) Continuation of application No. PCT/CN2023/129201, filed on Nov. 2, 2023.

(30) Foreign Application Priority Data

Jul. 26, 2023 (CN) ..... 202310923192.2
Jul. 26, 2023 (CN) ..... 202310923200.3

(51) Int. Cl.
*F04B 53/16* (2006.01)
*E21B 43/26* (2006.01)
*F04B 15/02* (2006.01)

(52) U.S. Cl.
CPC ..... *E21B 43/2607* (2020.05); *F04B 53/162* (2013.01); *F04B 15/02* (2013.01)

(58) Field of Classification Search
CPC ..... F04B 53/162; E21B 43/2607
See application file for complete search history.

(56) References Cited

U.S. PATENT DOCUMENTS 9,976,544 B2 * 5/2018 Morreale ..... F04B 39/125
11,519,395 B2 * 12/2022 Zhang ..... F04B 15/02
(Continued)

*Primary Examiner* — Michael Leslie
(74) *Attorney, Agent, or Firm* — Crowell & Moring LLP

(57) ABSTRACT

A fracturing pump spacer frame includes a hydraulic end connecting plate and a crosshead box connecting plate that are disposed spaced apart in parallel. The hydraulic end connecting plate and the crosshead box connecting plate are fastened by a support sleeve. The fracturing pump spacer frame further includes a leg. The hydraulic end connecting plate, the crosshead box connecting plate, the support sleeve, and the leg are integrally formed. The leg includes a first vertical supporting plate and a second vertical supporting plate that are vertically disposed and a first bottom supporting plate that is horizontally disposed. The first vertical supporting plate is located below the hydraulic end connecting plate. The second vertical supporting plate is located below the crosshead box connecting plate. Two sides of the first bottom supporting plate are respectively connected to lower ends of the first vertical supporting plate and the second vertical supporting plate. In the present disclosure, an integrally formed fracturing pump spacer frame is used, to avoid an impact of a welding defect on stiffness, strength, service life, and the like. An approximately U-shaped leg may support both a hydraulic end connecting plate and a crosshead box connecting plate, so that the number of support points is increased, a moment and a caused deformation are decreased, and service life is increased.

20 Claims, 9 Drawing Sheets

(56) References Cited

U.S. PATENT DOCUMENTS

| | | | | |
|---|---|---|---|---|
| 11,680,474 | B2 * | 6/2023 | Cui | H02K 7/1823 290/1 R |
| 12,044,234 | B2 * | 7/2024 | Li | F04B 1/0404 |
| 12,092,101 | B2 * | 9/2024 | Stephens | F04B 53/168 |
| 2020/0332788 | A1 * | 10/2020 | Cui | F04B 1/00 |
| 2021/0131409 | A1 * | 5/2021 | Cui | F04B 53/16 |

* cited by examiner

FRACTURING PUMP SPACER FRAME

CROSS-REFERENCE TO RELATED APPLICATIONS

This application is a continuation of and claims the benefit of priority to International PCT Application No. PCT/CN2023/129201 filed on Nov. 2, 2023, which is based on and claims the benefit of priority to Chinese Patent Applications No. 202310923200.3 and No. 202310923192.2 filed on Jul. 26, 2023, the disclosed content of which is hereby incorporated by reference in its entireties.

TECHNICAL FIELD

The present disclosure relates to a fracturing pump spacer frame, in the field of fracturing pump manufacturing technologies.

BACKGROUND

As important equipment that can increase oil and gas production, fracturing pumps are widely used in the oil industry to pressurize a fracturing fluid (for example, cement, slurry, fracturing sand or another material) and pump the fluid into a well to produce stratum fracturing.

A fracturing pump is mainly formed by three subsystems: a power end, a hydraulic end, and a reducer. The power end structurally connects the reducer and a valve box of the hydraulic end, and is functionally responsible for converting rotational mechanical energy transferred from the reducer into reciprocating mechanical energy, to drive fluid sucking and discharging functions of the hydraulic end. The hydraulic end pressurizes a low-pressure fluid into a high-pressure fluid, and outputs the high-pressure fluid into a high-pressure manifold. A power end assembly is mainly formed by a housing, a crank-connecting rod assembly, a crosshead lever assembly, a lubrication system, and the like. The housing of the power end includes a crankshaft box and a crosshead box. The crankshaft box is connected to an end of the crosshead box.

A fracturing pump spacer frame is used for connecting and supporting the crosshead box and the hydraulic end, to ensure a fixed distance between the two and provide a space for the reciprocation of a plunger.

A conventional spacer frame is usually formed by welding front and rear end plates, several support sleeves in the middle, and a bottom support plate. Because welding is a quick local heating and cooling process, molten metal in a welding zone cannot freely extend and retract due to the constraint and limitation of a body around, and is subjected to a tensile stress of a body material in a gradual cooling and contraction process. Although an internal stress generated from this volume change can be eliminated through a thermal treating process, a base metal (a heat-affected zone) that is around a welding seam and is affected by heat but does not melt encounters changes in a metallographic structure and mechanical performance, and a nonuniform structural distribution is generated under the action of welding heat circulation. Once an internal stress is generated from structural changes, the internal stress cannot be eliminated, and very easily turns into a fatigue crack source of a member. Under the action of a cyclic alternating stress when a fracturing pump operates at a high load for a long time and a corrosive medium, the heat-affected zone of the welding is very easily prone to microcracks, which expand into extensible cracks, and it is difficult to meet a use requirement of a long service life (>10000 h).

In addition, in terms of production and manufacturing, a production procedure of a welded spacer frame is complex, and it is difficult to ensure matching precision. A welded spacer frame needs to undergo a series of procedures such as unloading, grouping, spot welding, preheating, welding, polishing, thermal processing, crack detection, rough machining, secondary thermal processing, and finishing machining. The manufacturing precision and quality need to be strictly guaranteed in all the steps in this process, or otherwise size and shape errors tend to be accumulated and amplified. In a welding and grouping process, matching precision between the support sleeves and the two end plates directly affects position precision between components, and a specific clamping and positioning fixture is required. The matching difficulty is high, the clamp has high development costs, and the difficulty of subsequent rough and finishing machining is also high. Errors generated in the foregoing procedures may cause a subsequent abnormal fitting relationship, resulting in severe results such as local cracking, deformation vibration, and sealing leakage caused when the components are subjected to a nonuniform force.

SUMMARY

A technical problem to be resolved in the present disclosure is to provide a fracturing pump spacer frame in view of the deficiencies in the prior art. An integrally formed fracturing pump spacer frame is used, to avoid an impact of a welding defect on stiffness, strength, service life, and the like. An approximately U-shaped leg may support both a hydraulic end connecting plate and a crosshead box connecting plate, so that the number of support points is increased, a moment and a caused deformation are decreased, and service life is increased. For a single-side leg with a support rib plate, support stiffness is enhanced, and the leg is allowed to have a certain bending deformation. A varying diameter portion of a support sleeve increases flexural strength and support stiffness of a root portion of the support sleeve, and facilitates the implementation of a casting process.

The technical problem to be resolved in the present disclosure is resolved through the foregoing technical solution:

The present disclosure provides a fracturing pump spacer frame, including a hydraulic end connecting plate and a crosshead box connecting plate that are disposed spaced apart in parallel. The hydraulic end connecting plate and the crosshead box connecting plate are fastened by a support sleeve. A first bolt hole penetrating the hydraulic end connecting plate, the support sleeve, and the crosshead box connecting plate is further provided in the fracturing pump spacer frame. The fracturing pump spacer frame further includes a leg. The hydraulic end connecting plate, the crosshead box connecting plate, the support sleeve, and the leg are integrally formed. The leg includes a first vertical supporting plate and a second vertical supporting plate that are vertically disposed and a first bottom supporting plate that is horizontally disposed. The first vertical supporting plate is located below the hydraulic end connecting plate. The second vertical supporting plate is located below the crosshead box connecting plate. Two sides of the first bottom supporting plate are respectively connected to lower ends of the first vertical supporting plate and the second vertical supporting plate.

To maintain a balance and enable each leg to provide support, at least two legs are provided, and the legs are uniformly distributed in a length direction of the hydraulic end connecting plate. Further, each of the first vertical supporting plate and the second vertical supporting plate includes a first foot and a second foot, and lower ends of the first foot and the second foot are fastened.

To decrease a longitudinal reactive force and reduce a pressure and a moment to which the leg is subjected, the first foot is vertically disposed, the second foot is obliquely disposed, and an angle is formed between the first foot and the second foot.

To increase structural stiffness at a connection between the leg of the spacer frame and the connecting plate, upper ends of the first foot and the second foot are respectively located below different support sleeves.

To reduce bending of a root portion of the support sleeve and increase stiffness of the support sleeve, a foot reinforcing rib is disposed in a middle of an inner side of each of the first foot and the second foot, and the foot reinforcing rib is disposed in a length direction of each of the first foot and the second foot.

Further, a rounded corner is disposed at an edge of the foot reinforcing rib.

Further, a bottom plate reinforcing rib is disposed on the first bottom supporting plate in a direction parallel to an axial direction of the support sleeve, and two ends of the bottom plate reinforcing rib are respectively connected to the foot reinforcing ribs on the first feet of the first vertical supporting plate and the second vertical supporting plate.

To increase a bottom support area, keep the fracturing pump spacer frame from overturning longitudinally, and increase stability, a widening portion is disposed at an edge of an outer side of each of the first foot and the second foot.

The present disclosure further provides another fracturing pump spacer frame, including a hydraulic end connecting plate and a crosshead box connecting plate that are disposed spaced apart in parallel. The hydraulic end connecting plate and the crosshead box connecting plate are fastened by a support sleeve. A first bolt hole penetrating the hydraulic end connecting plate, the support sleeve, and the crosshead box connecting plate is further provided in the fracturing pump spacer frame. The hydraulic end connecting plate partially extends to a side to form a leg. The hydraulic end connecting plate, the crosshead box connecting plate, the support sleeve, and the leg are integrally formed. The leg includes a third vertical supporting plate that is vertically disposed and a second bottom supporting plate that is horizontally disposed. A first support rib plate is disposed at a connection between the third vertical supporting plate and the support sleeve located above the third vertical supporting plate. A second support rib plate is disposed at a connection between the third vertical supporting plate and the second bottom supporting plate. A gap zone is disposed between the first support rib plate and the second support rib plate.

To allow the leg to have a certain bending deformation and prevent the reinforcing ribs from pressing and shearing each other when the leg is subjected to a moment, a height of the gap zone is larger than 5 mm.

To avoid stress concentration and reduce a weight while ensuring strength, a thickness of each of the first support rib plate and the second support rib plate gradually decreases in a direction toward the gap zone, or, a thickness of each of the first support rib plate and the second support rib plate gradually decreases in a direction away from the third vertical supporting plate.

To facilitate a casting process and ensure flexural strength and support stiffness of a root portion of the support sleeve, the support sleeve includes a cylindrical portion and a varying diameter portion that is located at each of two ends of the cylindrical portion, and a diameter of the varying diameter portion gradually increases in a direction away from a center of the support sleeve.

In the foregoing two fracturing pump spacer frames, rounded corners are disposed at connections between the varying diameter portion and the cylindrical portion, the hydraulic end connecting plate, and the crosshead box connecting plate.

Preferably, a ratio of a length of the varying diameter portion in an axial direction of the support sleeve to a width of the varying diameter portion in a direction perpendicular to the axial direction of the support sleeve ranges from 2:1 to 4:1.

To facilitate mounting and disassembly of a packing lubrication joint, and the like, a hydraulic end opening is provided in a middle of the hydraulic end connecting plate, and a process hole is provided in a lower side of the hydraulic end opening.

To facilitate mounting and positioning of the hydraulic end connecting plate and a hydraulic end back plate, a positioning pin opening is provided in each of two sides of the hydraulic end connecting plate in a length direction, and heights of the positioning pin openings located in the two sides are different.

To further fasten the fracturing pump spacer frame, a second bolt hole is provided in the crosshead box connecting plate right above the first bolt hole in an upper side of the crosshead box connecting plate and right below the first bolt hole in a lower side of the crosshead box connecting plate; and two third bolt holes that are vertically arranged are respectively provided in two sides of the crosshead box connecting plate in a length direction.

To facilitate mounting of a first bolt, a concave platform is disposed at a periphery of a side of the second bolt hole away from a crosshead box.

To achieve oil discharging and gas discharging functions of the crosshead box, a lever opening is provided in a middle of the crosshead box connecting plate, and an avoidance groove is provided at a periphery of a side of the lever opening toward the crosshead box.

To increase a sealing effect, a sealing groove is provided in a side of the crosshead box connecting plate close to the crosshead box, the lever opening is located in an inner side of the sealing groove, the second bolt hole, the third bolt holes, and the first bolt hole are located in an outer side of the sealing groove, and the sealing groove is provided close to the first bolt hole.

In summary, in the present disclosure, an integrally formed fracturing pump spacer frame is used, to avoid an impact of a welding defect on stiffness, strength, service life, and the like. An approximately U-shaped leg may support both a hydraulic end connecting plate and a crosshead box connecting plate, so that the number of support points is increased, a moment and a caused deformation are decreased, and service life is increased. For a single-side leg with a support rib plate, support stiffness is enhanced, and the leg is allowed to have a certain bending deformation. A varying diameter portion of a support sleeve increases flexural strength and support stiffness of a root portion of the support sleeve, and facilitates the implementation of a casting process.

The technical solution of the present disclosure is described below in detail with reference to the accompanying drawings and specific embodiments.

DETAILED DESCRIPTION

Embodiment 1

Figure 1:
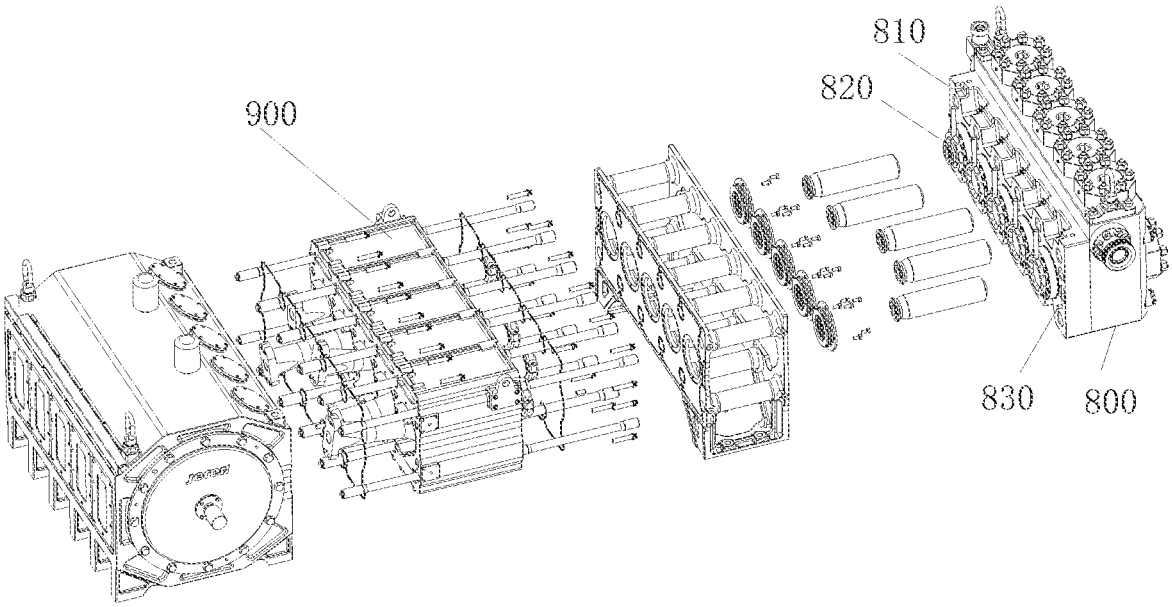
FIG. 1 is a first exploded schematic view of a fracturing pump according to Embodiment 1 of the present disclosure.
Figure 2:
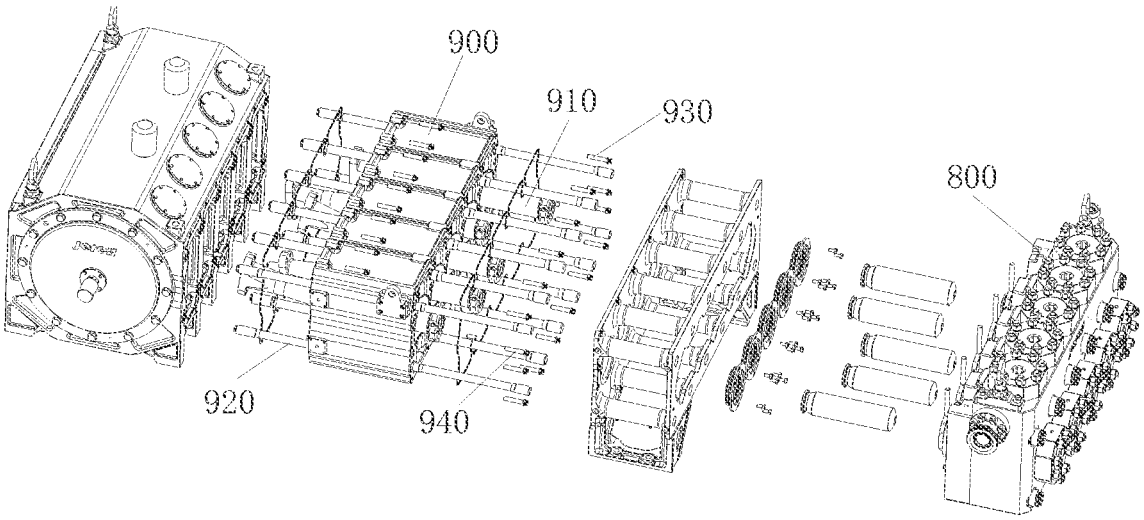
FIG. 2 is a second exploded schematic view of a fracturing pump according to Embodiment 1 of the present disclosure.
Figure 3:
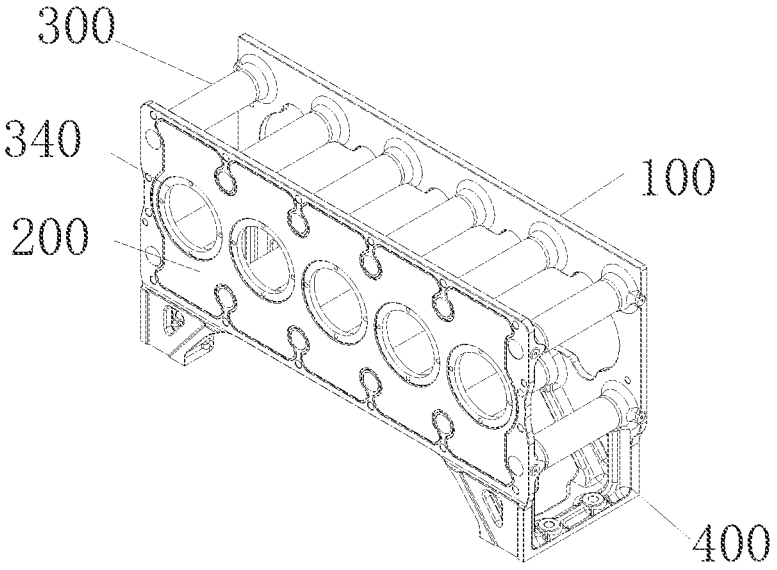
FIG. 3 is a schematic structural diagram of a fracturing pump spacer frame according to Embodiment 1 of the present disclosure.
Figure 4:
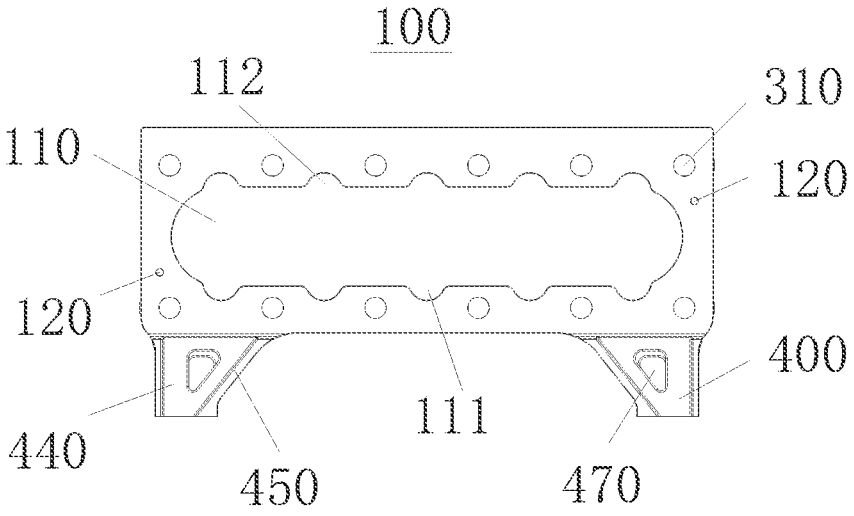
FIG. 4 is a side view of a hydraulic end connecting plate according to Embodiment 1 of the present disclosure.
Figure 5:
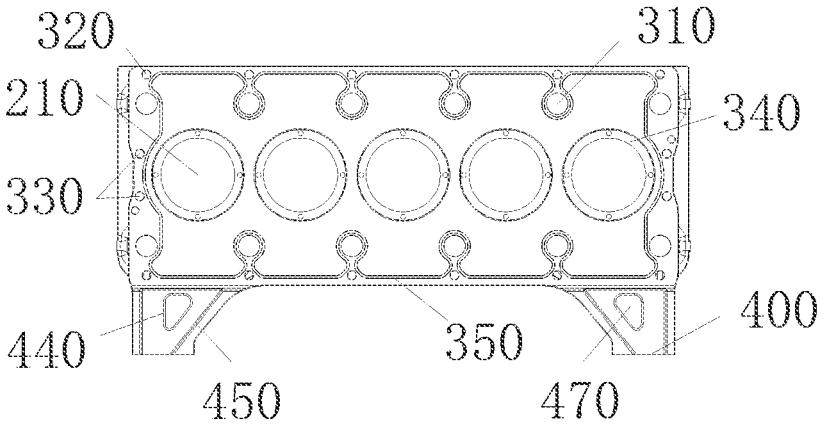
FIG. 5 is a side view of a crosshead box connecting plate according to Embodiment 1 of the present disclosure.
Figure 6:
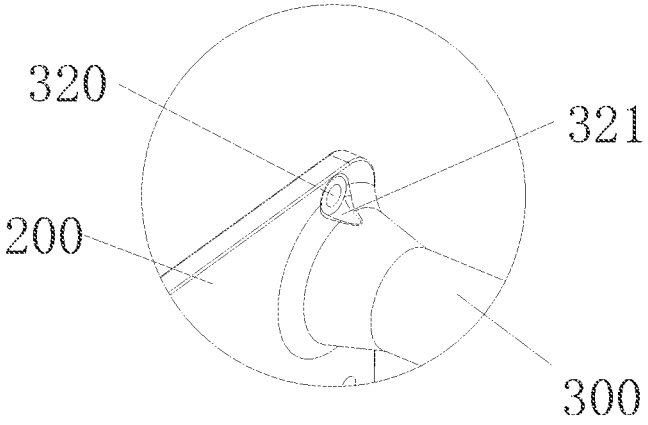
FIG. 6 is a partial enlarged view at a second bolt hole according to Embodiment 1 of the present disclosure.
Figure 7:
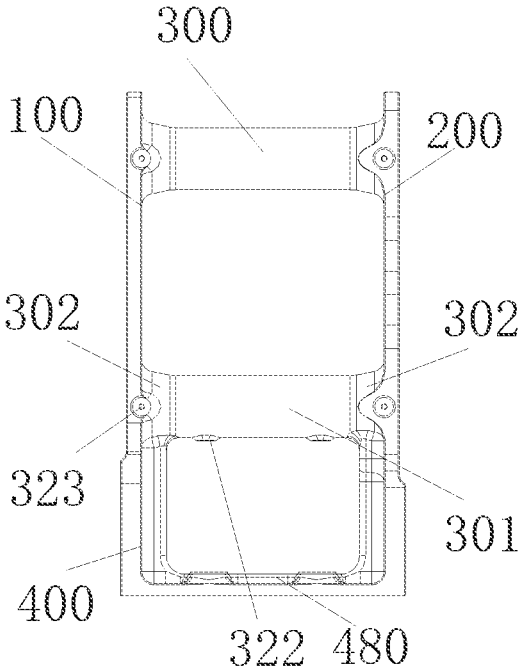
FIG. 7 is a side view of a fracturing pump spacer frame according to Embodiment 1 of the present disclosure.
Figure 8:
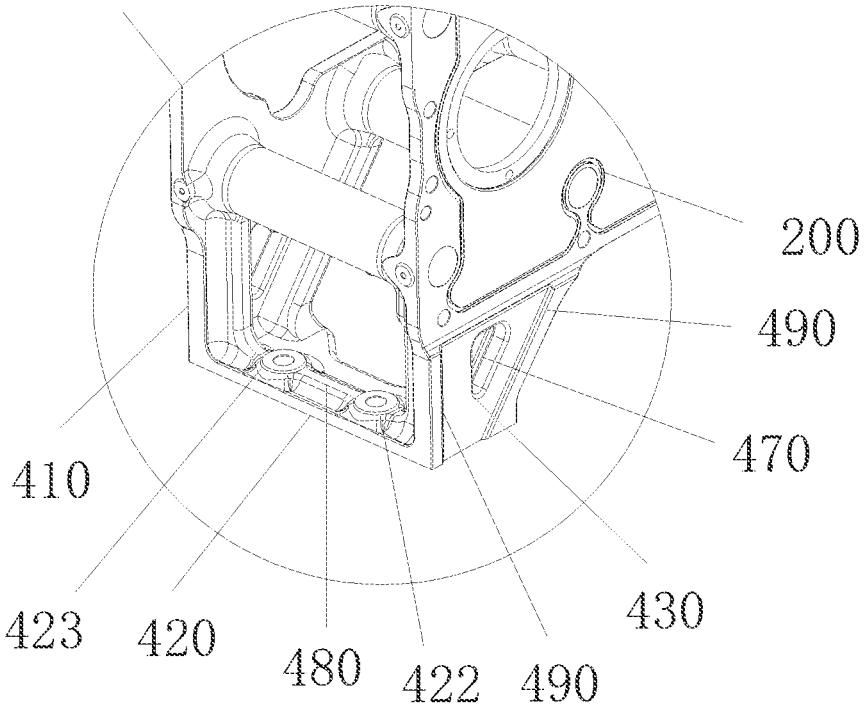
FIG. 8 is a partial enlarged view at a leg according to Embodiment 1 of the present disclosure.
Figure 9:
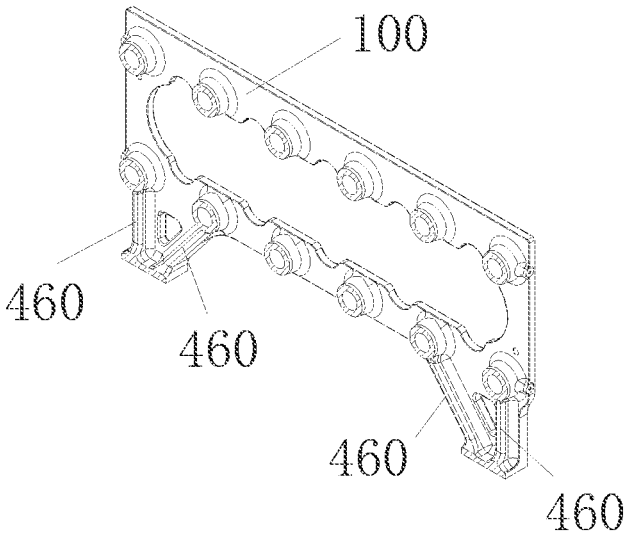
FIG. 9 is a cross-sectional view on a side of a hydraulic end connecting plate according to Embodiment 1 of the present disclosure.

FIG. 1 is a first exploded schematic view of a fracturing pump according to Embodiment 1 of the present disclosure; FIG. 2 is a second exploded schematic view of a fracturing pump according to Embodiment 1 of the present disclosure; FIG. 3 is a schematic structural diagram of a fracturing pump spacer frame according to Embodiment 1 of the present disclosure; FIG. 4 is a side view of a hydraulic end connecting plate according to Embodiment 1 of the present disclosure; FIG. 5 is a side view of a crosshead box connecting plate according to Embodiment 1 of the present disclosure; FIG. 6 is a partial enlarged view at a second bolt hole according to Embodiment 1 of the present disclosure; FIG. 7 is a side view of a fracturing pump spacer frame according to Embodiment 1 of the present disclosure; FIG. 8 is a partial enlarged view at a leg according to Embodiment 1 of the present disclosure; and FIG. 9 is a cross-sectional view on a side of a hydraulic end connecting plate according to Embodiment 1 of the present disclosure. As shown in FIG. 1 to FIG. 9, in Embodiment 1, the fracturing pump spacer frame of the present disclosure includes a hydraulic end connecting plate 100 and a crosshead box connecting plate 200 that are disposed spaced apart in parallel. The hydraulic end connecting plate 100 and the crosshead box connecting plate 200 are fastened by a support sleeve 300. A leg 400 is disposed below (below in a vertical direction in FIG. 4) the hydraulic end connecting plate 100 and the crosshead box connecting plate 200. The hydraulic end connecting plate 100, the crosshead box connecting plate 200, the support sleeve 300, and the leg 400 are integrally formed (including, but not limited to, integrally cast). A material of the fracturing pump spacer frame is ductile cast iron, vermicular cast iron, grey iron or cast steel. Preferably, the material of the fracturing pump spacer frame is ductile cast iron or vermicular cast iron.

A conventional fracturing pump spacer frame is formed through joining by using a welded process. Due to inherent welding defects, in a case that a welded structure of steel plates has insufficient overall stiffness, a local deformation and stress concentration of a welding seam accelerate fatigue, and the welded structure has poorer performance in a long-time flexural capability compared with an integrally formed structure. Through analysis from the perspective of force bearing, an entire fracturing pump has a large support span, weights of a crosshead box and a hydraulic end are mainly supported by the spacer frame, and the leg of the spacer frame bears a large payload and moment and becomes a stress concentration point, which easily causes a local deformation, or even a welding seam at a stress concentration and a nearby heat-affected zone crack. In addition, because a crosshead of each cylinder alternately enters a body of the crosshead box, the reciprocation of the center of gravity makes a moment that the welding seam bears change cyclically, and as a result a deformation amount changes cyclically, which may cause vibration at this position. The welding of steel plates has poorer cushioning and vibration absorption performance compared with an integral cast iron material. Under the action of a cyclic stress, expansion of a crack at a welding seam is further intensified, and eventually a support function fails.

In the present disclosure, through an integral formation process, a wall thickness of a weak moment zone can be flexibly increased and a reinforcing rib plate can be freely disposed, a complex procedure of welding and component manufacturing are omitted, and connecting strength and support stiffness of the spacer frame of the fracturing pump are greatly increased. In addition, the cast iron material can effectively implement cushioning and vibration absorption, ensure stable support, and increase the service life of the fracturing pump spacer frame.

The hydraulic end connecting plate 100 is used for being connected to a hydraulic end component 800 (for example, a hydraulic end back plate 810, or the like). A hydraulic end opening 110 is provided in a middle of hydraulic end connecting plate 100, to facilitate connection of a hydraulic end component (for example, a packing box pressure cap 820, or the like). To ensure support strength and reduce an overall weight, two ends of the hydraulic end opening 110 in a horizontal direction are semicircular, and the middle is rectangular. That is, the hydraulic end opening 110 has an elliptical track shape. A specific shape of the hydraulic end opening 110 is not limited in the present disclosure. A person skilled in the art may design and select the shape according to an actual case.

To facilitate the mounting and disassembly of the hydraulic end component 800 (for example, a packing lubrication joint, or the like). A process hole 111 is further provided in a lower side of the hydraulic end opening 110. The process hole 111 may be provided below each group of packing components. In other words, the arrangement of the process hole 111 may reserve an operation space for mounting, disassembly, maintenance, and the like of a packing component (for example, a packing lubrication joint, or the like).

To prevent water, oil, and a mixture thereof at a concave position of the hydraulic end connecting plate 100 from corroding the connecting plate, a pollutant discharging groove 112 is further provided in an upper side of the hydraulic end opening 110. The pollutant discharging groove 112 may be provided above each group of packing components.

The process hole 111 and the pollutant discharging groove 112 are preferably arc-shaped grooves, shapes of which are simple to facilitate casting. Shapes of the grooves are not limited in the present disclosure, and another shape design such as a rectangle or a square that facilitates mounting and disassembly may be used.

Positioning pin openings 120 are respectively provided in two sides of the hydraulic end connecting plate 100 in a length direction, and are provided corresponding to a positioning pin 830 on the hydraulic end component 800, to facilitate mounting and positioning of the hydraulic end connecting plate 100 and the hydraulic end back plate 810. It needs to be added that, heights of the positioning pin openings 120 located in the two sides are different, to avoid that the positioning pin 830 can still be mounted when the hydraulic end connecting plate is mounted reversely.

A first bolt hole 310 penetrating the hydraulic end connecting plate 100, the support sleeve 300, and the crosshead box connecting plate 200 is provided in the fracturing pump spacer frame. A long bolt 920 (for example, a double-end stud, or the like) of a crosshead box 900 passes through the first bolt hole 310 and is tightened at a tail end of the hydraulic end, to ensure reliable connections between connecting surfaces (between the crosshead box connecting plate and the crosshead box, and between the hydraulic end connecting plate and hydraulic end back plate).

A second bolt hole 320 is provided in the crosshead box connecting plate right above the first bolt hole 310 in an upper side of the crosshead box connecting plate and right below the first bolt hole 310 in a lower side of the crosshead box connecting plate 200. A first bolt 930 of the crosshead box 900 passes through the second bolt hole 320 to fasten the crosshead box connecting plate 200 and the crosshead box 900.

To facilitate mounting of the first bolt 930, a concave platform 321 (as shown in FIG. 6) is disposed at a periphery of a side of the second bolt hole 320 away from the crosshead box 900.

However, a connection between the crosshead box 900 and the fracturing pump spacer frame has low stiffness and a long lever arm and has a certain flexural deformation, and the crosshead box connecting plate 200 may deform and separate in a length direction. Therefore, two third bolt holes 330 that are vertically arranged are respectively provided in two sides (two sides in a transverse direction in FIG. 5) of the crosshead box connecting plate 200 in the length direction. A second bolt 1940 of the crosshead box 900 passes through the second bolt hole 320 to fasten the crosshead box connecting plate 200 and the crosshead box 900.

The crosshead box connecting plate 200 is used for being connected to the crosshead box 900. A lever opening 210 is provided in a middle of the crosshead box connecting plate 200. A lever 910 passes through the lever opening 210, and is driven by the crosshead to horizontally reciprocate, to convert rotation of a crankshaft into reciprocation of a plunger.

It needs to be noted that because of movement characteristics of a crosshead component, the crosshead box 900 needs to have oil discharging and gas discharging functions. In the prior art, oil discharging and gas discharging are usually implemented by reserving an oil discharging and gas discharging hole in a box body of the crosshead box 900 or in another manner. As a result, the crosshead box 900 has a complex structure, and mechanical strength of the crosshead box 900 is reduced. To resolve the foregoing problem, an avoidance groove 340 is provided at a periphery of a side of the lever opening 210 toward the crosshead box 900. When the crosshead component moves to a position closest to the crosshead box connecting plate 200, with the presence of the avoidance groove 340, the crosshead component does not contact the crosshead box connecting plate 200 but has a gap from the crosshead box connecting plate 200. The gap can ensure the oil discharging and gas discharging functions required by the crosshead box 900.

Further, to avoid as much as possible that a lubricant is taken out of the crosshead box 900 by the crosshead component, a sealing component (not shown in the figure) and a positioning groove (not shown in the figure) mounted fitting the sealing component are disposed on a side of the lever opening 210 away from the crosshead box 900.

As can be learned from above, in the present disclosure, the crosshead box 900 and the fracturing pump spacer frame are connected by two sets of bolts. The first set of bolts is the long bolt 920 that passes through the first bolt hole 310 and is used for overall fastening and pretightening. The second set of bolts is the first bolt 930 and the second bolt 1940 that respectively pass through the second bolt hole 320 and the third bolt holes 330 in the crosshead box connecting plate 200, and is used for sealing and fastening between the crosshead box 900 and fracturing pump spacer frame. Further, to better ensure a sealing effect, a sealing groove 350 used for placing a sealing ring or a sealing loop or filling a sealant is provided in a side of the crosshead box connecting plate 200 close to the crosshead box 900. The present disclosure is not limited thereto. The crosshead box connecting plate 200 and the crosshead box 900 may be directly bonded by a sealant, and the sealing groove 350 is omitted.

It needs to be added that, to improve sealing reliability, a length of the sealing groove 350 needs to be maximized. However, to make the entire first bolt hole 310 have a uniform gas pressure, the sealing groove 350 cannot completely surround the first bolt hole 310. Therefore, the lever opening 210 is located in an inner side of the sealing groove 350. The second bolt hole 320, the third bolt holes 330, and the first bolt hole 310 are located in an outer side of the sealing groove 350, and the sealing groove 350 is provided close to the first bolt hole 310.

A formation manner of the sealing groove 350 is not limited in the present disclosure. Apart from machining, another manner of removing a material may be used. In addition, it is to be noted that an arrangement position of the sealing groove 350 needs to avoid a crankshaft box observation window and a crosshead box gas discharging cavity at the same time.

Through the foregoing structure, the present disclosure can avoid oil and gas leakage, to avoid adverse results caused by lubricant pollution, corrosion and wear of internal metal members, and the like caused by moisture. Compared with connection and sealing with one set of bolts, double fastening and connection of two sets of bolts can effectively ensure joining and fastening of sealing surfaces, avoid separation and slippage of sealing surfaces caused by a plunging force and a connecting rod lateral force, and block leakage of oil, gas, and oil pressure.

The support sleeve 300 includes a cylindrical portion 301 and a varying diameter portion (or tapered portion) 302 that is located at each of two ends of the cylindrical portion 301. That is, the varying diameter portion 302 is disposed at each of connections between the support sleeve 300 and the hydraulic end connecting plate 100 and the crosshead box connecting plate 200. A diameter of the varying diameter portion 302 gradually increases in a direction away from a center of the support sleeve 300. A specific shape of the varying diameter portion 302 is not limited in the present disclosure. Preferably, the varying diameter portion 302 has a frustum shape. In this case, a cross-section of the varying diameter portion 302 is a trapezoid. Alternatively, the varying diameter portion 302 has a flared shape.

Further, rounded corners are disposed at connections between the varying diameter portion 302 and the cylindrical portion 301, between the varying diameter portion 302 and the hydraulic end connecting plate 100, and between the varying diameter portion 302 and the crosshead box connecting plate 200.

In one aspect, molten iron throttles and accumulates when flowing through an abrupt corner at a high speed during pouring, and stress concentration tends to occur as the molten iron gradually cools. The arrangement of the varying diameter portion 302 can implement a gradual transition of a corner, to increase punching efficiency of the molten iron, and avoid defects such as shrinkage and cold cracks of a cast due to structural accumulation and stress concentration of metal. In addition, erosion and damage of a sand mold corner caused by vortices and bubbles generated when the molten iron impacts the abrupt corner at a high speed can also be avoided. In another aspect, bending stress concentration and a deformation occur at a welding seam of a connection between a support sleeve and a side plate of a conventional welded spacer frame, and the welding seam is easily prone to cracking. Crossheads alternately enter a crosshead box, the reciprocation of the center of gravity makes a moment that the welding seam bears change cyclically, and as a result a deformation amount changes cyclically, which may cause vibration at this position. Under the action of a cyclic stress, expansion of a crack at a welding seam is further intensified. The varying diameter portion 302 increases a diameter of a root portion of the support sleeve 300, and increases flexural strength and support stiffness of the root portion of the support sleeve.

To enable the varying diameter portion 302 to further facilitate a casting process while increasing the strength and stiffness of the support sleeve 300, an aspect ratio of the varying diameter portion 302 is 2:1 to 4:1. That is, a ratio of a length of the varying diameter portion 302 in an axial direction of the support sleeve 300 to a width (a difference between a radius of the varying diameter portion 302 and a radius of the cylindrical portion 301) of the varying diameter portion 302 in a direction perpendicular to the axial direction of the support sleeve 300 is 2:1 to 4:1. A size of the rounded corner preferably ranges from R15 to R20.

As can be learned from above, because of the convenience of plasticity in casting, a wall thickness of the support sleeve 300 may change as a stress distribution changes. That is, the support sleeve 300 is cast into a structure that is thick (has a large wall thickness) at two ends and is slightly thin (has a small wall thickness) in the middle. A diameter of the first bolt hole 310 in the support sleeve 300 needs to be kept consistent. This can effectively increase flexural strength of the root portion of the support sleeve 300 and reduce an overall weight, and the shape further facilitates casting.

Arrangement positions and an arrangement quantity of the support sleeves 300 are not limited in the present disclosure, and may be correspondingly set according to a quantity and positions of the first bolts 930 of the crosshead box 900. Preferably, two horizontal rows of support sleeves 300 that are respectively located on an upper side and a lower side of the lever opening 210 are disposed.

In addition, an oil receiving tray bolt hole 322 used for mounting an integral oil receiving tray may be provided at a bottom of the support sleeve 300, a pump cover plate bolt hole 323 used for mounting a fracturing pump cover plate or the like may be further provided in a side surface of the support sleeve 300.

The fracturing pump spacer frame is used for connecting and supporting a crosshead box and a hydraulic end in a fracturing pump. During fracturing, for a fracturing pump with a large power above 4000 hp, a structure of a fracturing pump spacer frame with a single-sided support leg (that is, a structure in which a leg is only disposed below the hydraulic end connecting plate 100 or a leg is only disposed below the crosshead box connecting plate 200) is insufficient to support vibrations of a large amplitude and a weight. Specifically, the fracturing pump spacer frame is placed between the crosshead box and the hydraulic end. The long bolt that passes through the first bolt hole 310 tightly connects the crosshead box and the hydraulic end. Weights of the two and the fracturing pump spacer frame, vibrations in a movement process, and the like all rely on supporting and bearing of the spacer frame, a connecting portion of the spacer frame bears a huge shearing force and moment, and a structural failure is caused very easily after long-time operation.

In the present disclosure, a manner of double-sided legs is used for the fracturing pump spacer frame. That is, the legs 400 are disposed below both the hydraulic end connecting plate 100 and the crosshead box connecting plate 200. It is proved through experiments and practice that the legs 400 can achieve good support and vibration reduction effects, improve a load bearing status at a connection, and extend the service life of the fracturing pump spacer frame.

Specifically, the leg 400 is approximately U-shaped, and includes a first vertical supporting plate 410 and a second vertical supporting plate 430 that are vertically disposed and a first bottom supporting plate 420 that is horizontally disposed. Lower ends of the first vertical supporting plate 410 and the second vertical supporting plate 430 are respectively connected to two sides of the first bottom supporting plate 420. The first vertical supporting plate 410 is located below the hydraulic end connecting plate 100. The second vertical supporting plate 430 is located below the crosshead box connecting plate 200. At least two legs 400 are provided, and are uniformly distributed in a length direction of the hydraulic end connecting plate 100. In this embodiment, two legs 400 are provided, and are respectively located at two ends of the hydraulic end connecting plate 100 in the length direction.

In an actual case, a side of the crosshead box 900 connected to a crankshaft box (a side of the crosshead box 900 away from the fracturing pump spacer frame) is connected by a plurality of sets of bolts. The side of the crosshead box 900 connected to the crankshaft box is considered as a fastened support end. In a case that a single-sided support is used for a conventional fracturing pump spacer frame, weights of the crosshead box 900, the fracturing pump spacer frame, the hydraulic end are only supported by the foregoing fastened support end and the single-sided leg of the fracturing pump spacer frame, and the support of the fracturing pump spacer frame bears a large force. During the reciprocation of the crosshead component, the largest moment is generated at the center of gravity of the crosshead component. When the center of gravity of the crosshead component moves to a position closest to the fracturing pump spacer frame, in this case, a moment that a connection between the crosshead box and the fracturing pump spacer frame bears reaches a maximum, and pulling forces that cause separation of the connecting surfaces to the outside from two sides on the connecting surfaces also reach a maximum, which tends to cause risks that the connecting surfaces are separated, a connecting bolt deforms and fails, and the connecting surfaces slips downward, which may cause oil and gas leakage. On the other side of the fracturing pump spacer frame, the hydraulic end has a large weight and also generates a moment and a shearing force. In addition, related components generate and are subjected to some vibrations in a movement process. Multiple payloads are coupled and are loaded at a single-sided support of the spacer frame. After long-time running, a connection is easily prone to a deformation, to cause a fatigue failure.

A double-sided support design is used in the fracturing pump spacer frame of the present disclosure, and the arrangement of the first vertical supporting plate 410 and the second vertical supporting plate 430 increases a quantity of support positions of the fracturing pump spacer frame. When the crosshead component moves to a position closest to the fracturing pump spacer frame, because a group of support structures (the second vertical supporting plate 430) are added, a distance between support points on two sides of the crosshead box is reduced, a moment to which a connection between the crosshead box and the fracturing pump spacer frame is subjected is also reduced, and pulling forces toward the outside from two sides on the connecting surfaces decrease, thereby improving a load bearing status of the connecting surfaces between the crosshead box and the fracturing pump spacer frame. For supporting and connection of the hydraulic end, because double-sided support is used for the fracturing pump spacer frame, force bearing of the original single-sided leg is shared, and a moment and a caused deformation are decreased, thereby increasing the service life.

The first bottom supporting plate 420 connects the first vertical supporting plate 410 and the second vertical supporting plate 430, and is used for supporting and connecting the first vertical supporting plate 410 and the second vertical supporting plate 430 transversely (in a horizontal direction, that is, a direction in which the lever 910 moves horizontally), to keep the first vertical supporting plate 410 and the second vertical supporting plate 430 from deforming and tilting, and at the same time increase a connection area between a bottom of the fracturing pump spacer frame and the ground, a bottom skid, or the like, thereby increasing support stiffness and stability.

The material of the fracturing pump spacer frame is preferably ductile cast iron or vermicular cast iron. Because cast iron has a modulus of elasticity lower than of cast steel, for the fracturing pump spacer frame made of a cast iron material, the fracturing pump spacer frame may be allowed to shake transversely (a direction in which the lever 910 moves horizontally), to keep a stress from concentrating at the connection between the leg and the bottom when the fracturing pump spacer frame is subjected to a transverse force, thereby reducing a frictional force required for fastening the bolt at the bottom of the fracturing pump spacer frame. If the leg of the fracturing pump spacer frame has large stiffness and is not allowed to shake, when being subjected to a transverse force, there is stress concentration at the connection at the leg that remains stationary, and the bolt at the bottom requires a larger frictional force to keep the spacer frame from shaking.

At least two bottom plate fastening holes 422 are provided in the middle of the first bottom supporting plate 420, and are distributed on the first bottom supporting plate 420 in a direction parallel to the axial direction of the support sleeve 300. The fracturing pump spacer frame may be fastened at a predetermined position (for example, a bottom fastening support structurally such as a bottom skid) through the bottom plate fastening hole 422. Preferably, two bottom plate fastening holes 422 are provided.

To increase connection stiffness at the bottom plate fastening hole 422, avoid a connection deformation at this position, and ensure a stable connection between the fracturing pump spacer frame and the bottom skid or the like, a boss 423 is disposed at the bottom plate fastening hole 422, that is, a thickness around the bottom plate fastening hole 422 is larger than a thickness at another position of the first bottom supporting plate 420.

For flexural strength of a root portion of the leg 400, because inclined support can decompose a vertically downward pressure into a horizontally pushing force, a longitudinal reactive force is decreased, and a pressure and a moment to which the leg is subjected to are reduced. Therefore, each of the first vertical supporting plate 410 and the second vertical supporting plate 430 in the present disclosure includes a first foot 440 and a second foot 450. Lower ends of the first foot 440 and the second foot 450 are fastened. Upper ends of the second foot 450 and the first foot 440 are respectively connected to the hydraulic end connecting plate 100 and the crosshead box connecting plate 200. To decrease a longitudinal reactive force and reduce a pressure and a moment to which the leg is subjected, the first foot 440 is vertically disposed, the second foot 450 is obliquely disposed, and an angle is formed between the first foot 440 and the second foot 450.

Specifically, the upper ends of the first foot 440 and the second foot 450 of the first vertical supporting plate 410 are connected to the hydraulic end connecting plate 100. The upper ends of the first foot 440 and the second foot 450 of the second vertical supporting plate 430 are connected to the crosshead box connecting plate 200. The first foot 440 and the second foot 450 form the first vertical supporting plate 410 and the second vertical supporting plate 430 that are wide at the top and narrow at the bottom (a triangular shape).

It is to be noted that quantities and connection manners of the legs and feet are not limited in the present disclosure. For example, three or more legs 400 are provided, and may be uniformly distributed below the hydraulic end connecting plate 100 and the crosshead box connecting plate 200. Alternatively, or additionally, leg vertical plates may be not fastened. For example, when three legs 400 are provided, the leg 400 located in the middle may only include the first vertical supporting plate 410 and the second vertical supporting plate 430 that are vertically disposed but does not include the first bottom supporting plate 420 that is horizontally disposed. Further, according to an actual case, feet of different legs 400 may be fastened by a bottom plate.

To increase the structural stiffness at the connection between the leg of the spacer frame and the connecting plate, the upper ends of the first foot 440 and the second foot 450 are respectively located below different support sleeves 300. Preferably, the upper ends of the first foot 440 and the second foot 450 are respectively located below the support sleeves 300 that are horizontally adjacent.

In consideration of that bending of the root portion of the support sleeve 300 above the leg 400 is hindered by the first vertical supporting plate 410 and the second vertical supporting plate 430, internal structures press each other to cause stress concentration. Therefore, a foot reinforcing rib 460 is disposed in a middle of an inner side (a side close to a center of the fracturing pump spacer frame) of each of the first foot 440 and the second foot 450. The foot reinforcing rib 460 is disposed in a length direction of each of the first foot 440 and the second foot 450. The foot reinforcing rib 460 can reduce bending of the root portion of the support sleeve 300, thereby increasing the stiffness of the support sleeve 300.

More preferably, an upper end of the foot reinforcing rib 460 is connected to the varying diameter portion 302 of the support sleeve 300, thereby ensuring overall support stiffness. The first foot 440 and the second foot 450 that use a triangular support design can ensure that a fracturing pump spacer frame does not shake longitudinally. In some example implementations, a reinforcing rib (not shown in the figure) that is horizontally disposed may be added between two horizontally adjacent support sleeves.

To ensure that the foot reinforcing rib 460 has sufficient bending stiffness, a displacement and a deformation of the leg 400 can be inhibited, and a horizontal cross-section of the foot reinforcing rib 460 is approximately rectangular. The reason is that through comparison between solid regular cross-sections (for example, a circular cross-section, a square cross-section, and the like) with the same area, a cross-section along a major axis of a rectangle has a larger moment of inertia. Certainly, the present disclosure is not limited thereto. The horizontal cross-section of the foot reinforcing rib 460 may be replaced as required with any cross-section shape that meets support requirements and a casting process.

To reduce stress concentration and facilitate casting, a rounded corner is disposed at an edge of the foot reinforcing rib 460.

Because the first foot 440 and the second foot 450 are obliquely disposed, a through hole 470 is provided in a middle of each of the first vertical supporting plate 410 and the second vertical supporting plate 430. The through hole 470 can keep internal structures nearby the foot reinforcing rib 460 from pressing each other to cause stress concentration, and at the same time implement release of an internal stress and structural weight reduction.

Further, a bottom plate reinforcing rib 480 is disposed on the first bottom supporting plate 420 in a direction parallel to an axial direction of the support sleeve 300, and two ends of the bottom plate reinforcing rib 480 are respectively connected to the foot reinforcing ribs 460 on the first foot 440 of the first vertical supporting plate 410 and the second vertical supporting plate 430, thereby increasing support strength, and keeping a connection between the leg 400 and the bottom from being snapped when the fracturing pump spacer frame is subjected to a transverse force.

In addition, to increase a bottom support area, keep the fracturing pump spacer frame from overturning longitudinally, and increase stability, a widening portion 490 is disposed at an edge on an outer side (a side away from the center of the fracturing pump spacer frame) of each of the first foot 440 and the second foot 450. A thickness of the widening portion 490 is larger than thicknesses of the first foot 440 and the second foot 450.

Embodiment 2

Figure 10:
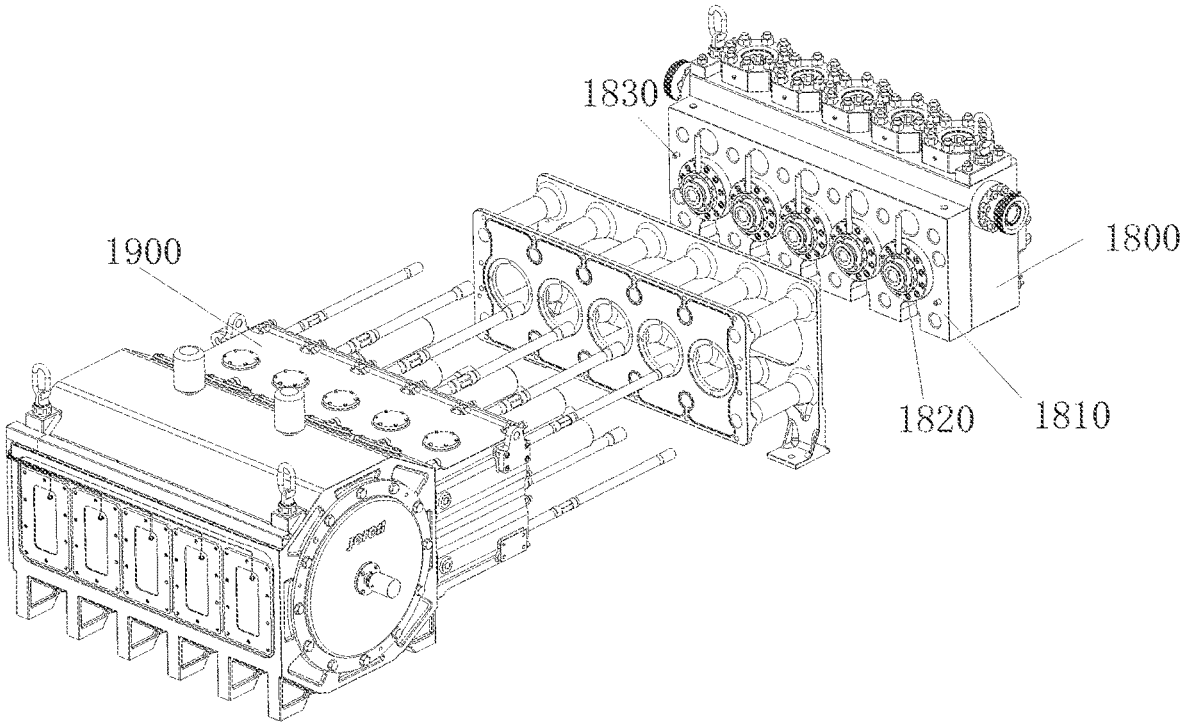
FIG. 10 is a first exploded schematic view of a fracturing pump according to Embodiment 2 of the present disclosure.
Figure 11:
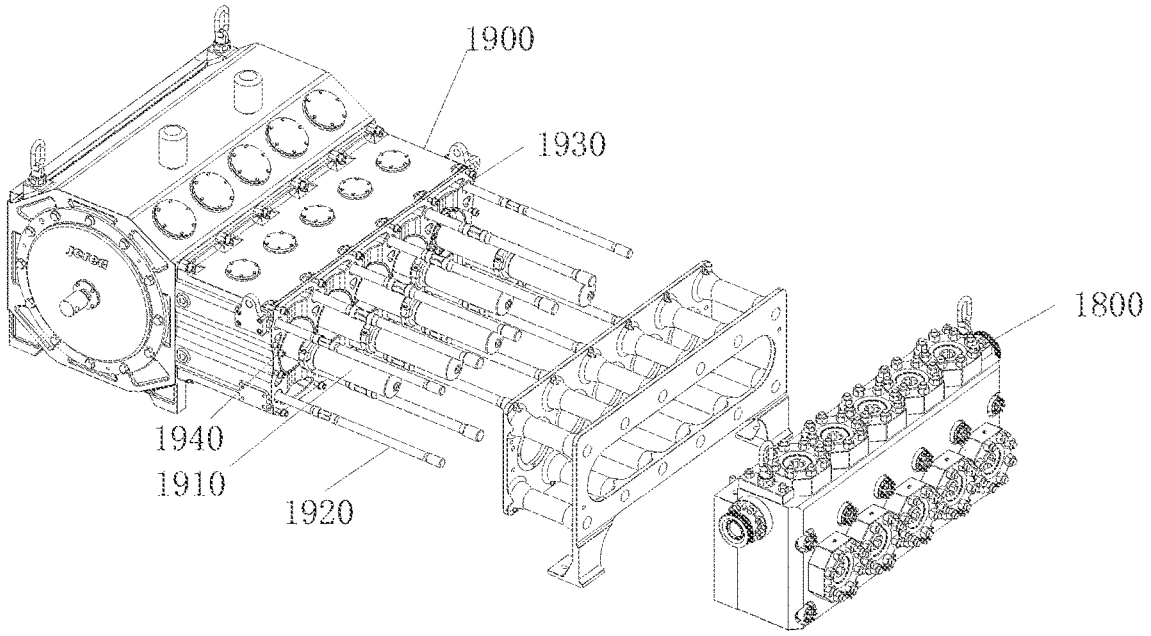
FIG. 11 is a second exploded schematic view of a fracturing pump according to Embodiment 2 of the present disclosure.
Figure 12:
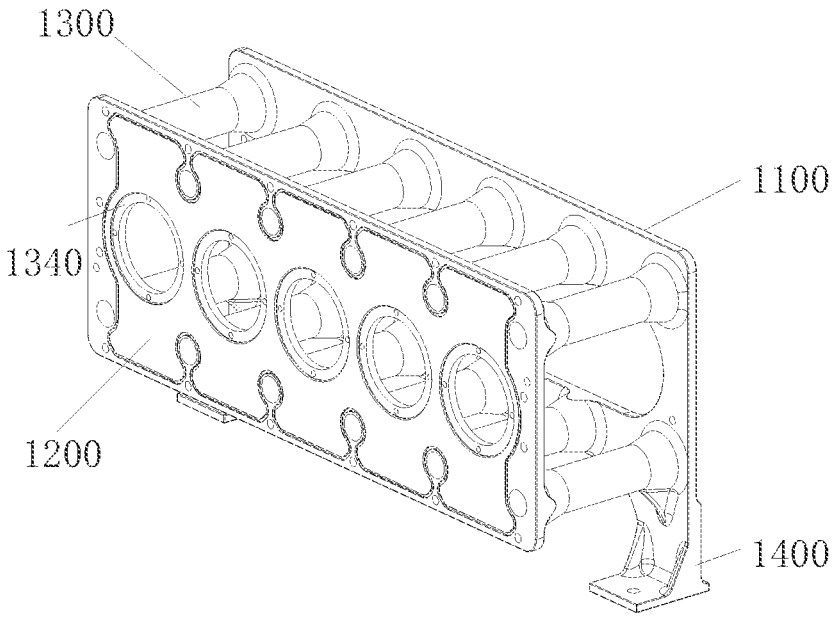
FIG. 12 is a schematic structural diagram of a fracturing pump spacer frame according to Embodiment 2 of the present disclosure.
Figure 13:
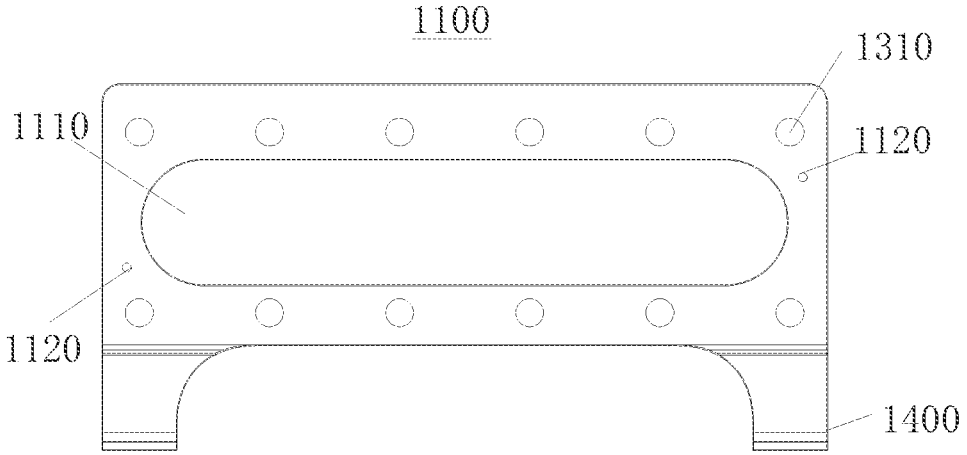
FIG. 13 is a side view of a hydraulic end connecting plate according to Embodiment 2 of the present disclosure.
Figure 14:
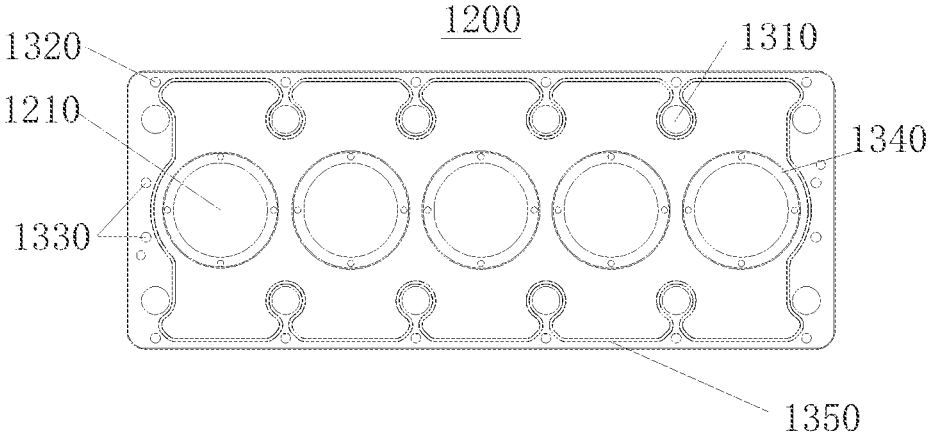
FIG. 14 is a side view of a crosshead box connecting plate according to Embodiment 2 of the present disclosure.
Figure 15:
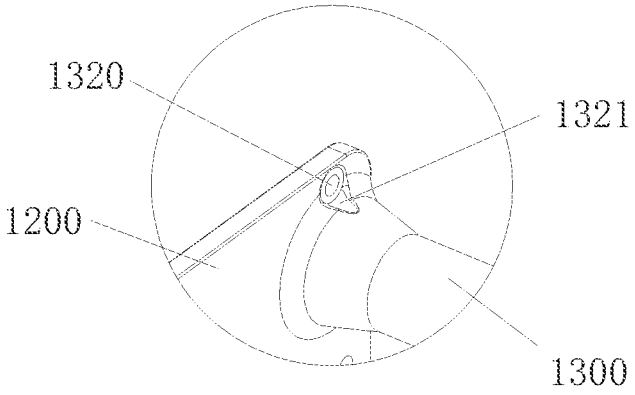
FIG. 15 is a partial enlarged view at a second bolt hole according to Embodiment 2 of the present disclosure.
Figure 16:
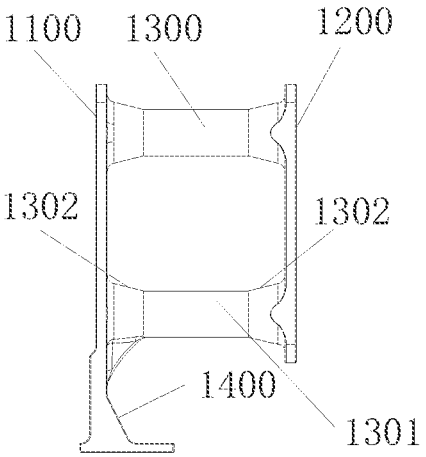
FIG. 16 is a side view of a fracturing pump spacer frame according to Embodiment 2 of the present disclosure.
Figure 17:
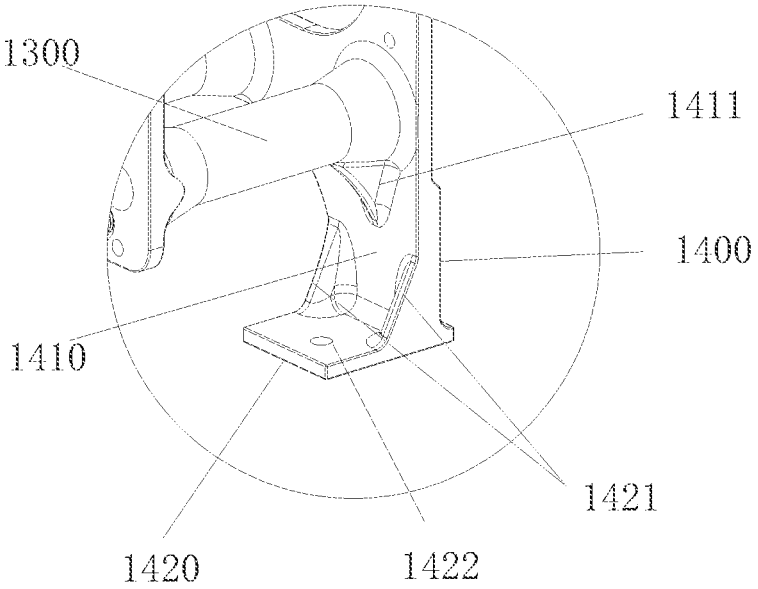
FIG. 17 is a partial enlarged view at a leg according to Embodiment 2 of the present disclosure.

FIG. 10 is a first exploded schematic view of a fracturing pump according to Embodiment 2 of the present disclosure; FIG. 11 is a second exploded schematic view of a fracturing pump according to Embodiment 2 of the present disclosure; FIG. 12 is a schematic structural diagram of a fracturing pump spacer frame according to Embodiment 2 of the present disclosure; FIG. 13 is a side view of a hydraulic end connecting plate according to Embodiment 2 of the present disclosure; FIG. 14 is a side view of a crosshead box connecting plate according to Embodiment 2 of the present disclosure; FIG. 15 is a partial enlarged view at a second bolt hole according to Embodiment 2 of the present disclosure; FIG. 16 is a side view of a fracturing pump spacer frame according to Embodiment 2 of the present disclosure; and FIG. 17 is a partial enlarged view at a leg according to Embodiment 2 of the present disclosure. As shown in FIG. 10 to FIG. 17, in Embodiment 2, the fracturing pump spacer frame of the present disclosure includes a hydraulic end connecting plate 1100 and a crosshead box connecting plate 1200 that are disposed spaced apart in parallel. The hydraulic end connecting plate 1100 and the crosshead box connecting plate 1200 are fastened by a support sleeve 1300. The hydraulic end connecting plate 1100 partially extends to a side to form a leg 1400. In other words, a side (a lower side in a vertical direction in FIG. 13) on which the leg 1400 is located is a bottom side. The hydraulic end connecting plate 1100 partially extends downward (toward the bottom side) to form the leg 1400. The hydraulic end connecting plate 1100, the crosshead box connecting plate 1200, the support sleeve 1300, and the leg 1400 are integrally formed (including, but not limited to, integrally cast). A material of the fracturing pump spacer frame is ductile cast iron, vermicular cast iron, grey iron or cast steel. Preferably, the material of the fracturing pump spacer frame is ductile cast iron or vermicular cast iron.

A conventional fracturing pump spacer frame is formed through joining by using a welded process. Due to inherent welding defects, in a case that a welded structure of steel plates has insufficient overall stiffness, a local deformation and stress concentration of a welding seam accelerate fatigue, and the welded structure has poorer performance in a long-time flexural capability compared with an integrally formed structure. Through analysis from the perspective of force bearing, an entire fracturing pump has a large support span, weights of a crosshead box and a hydraulic end are mainly supported by the spacer frame, and the leg of the spacer frame bears a large payload and moment and becomes a stress concentration point, which easily causes a local deformation, or even a welding seam at a stress concentration and a nearby heat-affected zone crack. In addition, because a crosshead of each cylinder alternately enters a body of the crosshead box, the reciprocation of the center of gravity makes a moment that the welding seam bears change cyclically, and as a result a deformation amount changes cyclically, which may cause vibration at this position. The welding of steel plates has poorer cushioning and vibration absorption performance compared with an integral cast iron material. Under the action of a cyclic stress, expansion of a crack at a welding seam is further intensified, and eventually a support function fails.

In the present disclosure, through an integral formation process, a wall thickness of a weak moment zone can be flexibly increased and a reinforcing rib plate can be freely disposed, a complex procedure of welding and component manufacturing are omitted, and connecting strength and support stiffness of the spacer frame of the fracturing pump are greatly increased. In addition, the cast iron material can effectively implement cushioning and vibration absorption, ensure stable support, and increase the service life of the fracturing pump spacer frame.

The hydraulic end connecting plate 1100 is used for being connected to a hydraulic end component 1800 (for example, a hydraulic end back plate 1810, or the like). A hydraulic end opening 1110 is provided in a middle of hydraulic end connecting plate 1100, to facilitate connection of a hydraulic end component (for example, a packing box pressure cap 1820, or the like). To ensure support strength and reduce an overall weight, two ends of the hydraulic end opening 1110 in a horizontal direction are semicircular, and the middle is rectangular. That is, the hydraulic end opening 1110 has an elliptical track shape. A specific shape of the hydraulic end opening 1110 is not limited in the present disclosure. A person skilled in the art may design and select the shape according to an actual case.

To facilitate the mounting and disassembly of the hydraulic end component 1800 (for example, a packing lubrication joint, or the like). A process hole (not shown in the figure) is further provided in a lower side of the hydraulic end opening 1110. The process hole may be provided below each group of packing components. In other words, the arrangement of the process hole may reserve an operation space for mounting, disassembly, maintenance, and the like of a packing component (for example, a packing lubrication joint, or the like).

To prevent water, oil, and a mixture thereof at a concave position of the hydraulic end connecting plate 1100 from corroding the connecting plate, a pollutant discharging groove (not shown in the figure) is further provided in an upper side of the hydraulic end opening 1110. The pollutant discharging groove may be provided above each group of packing components.

The process hole and the pollutant discharging groove are preferably arc-shaped grooves, shapes of which are simple to facilitate casting. Shapes of the grooves are not limited in the present disclosure, and another shape design such as a rectangle or a square that facilitates mounting and disassembly may be used.

Positioning pin openings 1120 are respectively provided in two sides of the hydraulic end connecting plate 1100 in a length direction, and are provided corresponding to a positioning pin 1830 on the hydraulic end component 1800, to facilitate mounting and positioning of the hydraulic end connecting plate 1100 and the hydraulic end back plate 1810. It needs to be added that, heights of the positioning pin openings 1120 located in the two sides are different, to avoid that the positioning pin 1830 can still be mounted when the hydraulic end connecting plate is mounted reversely.

A first bolt hole 1310 penetrating the hydraulic end connecting plate 1100, the support sleeve 1300, and the crosshead box connecting plate 1200 is provided in the fracturing pump spacer frame. A long bolt 1920 (for example, a double-end stud, or the like) of a crosshead box 1900 passes through the first bolt hole 1310 and is tightened at a tail end of the hydraulic end, to ensure reliable connections between contact surfaces (between the crosshead box connecting plate and the crosshead box, and between the hydraulic end connecting plate and hydraulic end back plate).

A second bolt hole 1320 is provided in the crosshead box connecting plate right above the first bolt hole 1310 in an upper side of the crosshead box connecting plate and right below the first bolt hole 1310 in a lower side of the crosshead box connecting plate 1200. A first bolt 1930 of the crosshead box 1900 passes through the second bolt hole 1320 to fasten the crosshead box connecting plate 1200 and the crosshead box 1900.

To facilitate mounting of the first bolt 1930, a concave platform 1321 (as shown in FIG. 15), or concave recess is disposed at a periphery of a side of the second bolt hole 1320 away from the crosshead box 1900 (in other words, on a surface of the crosshead box connecting plate facing the hydraulic end connecting plate).

However, a connection between the crosshead box 1900 and the fracturing pump spacer frame has low stiffness and a long lever arm and has a certain flexural deformation, and the crosshead box connecting plate 1200 may deform and separate in a length direction. Therefore, two third bolt holes 1330 that are vertically arranged are respectively provided in two sides (two sides in a transverse direction in FIG. 14) of the crosshead box connecting plate 1200 in the length direction. A second bolt 1940 of the crosshead box 1900 passes through the second bolt hole 1320 to fasten the crosshead box connecting plate 1200 and the crosshead box 1900.

The crosshead box connecting plate 1200 is used for being connected to the crosshead box 1900. A lever opening 1210 is provided in a middle of the crosshead box connecting plate 1200. A lever 1910 passes through the lever opening 1210, and is driven by the crosshead to horizontally reciprocate, to convert rotation of a crankshaft into reciprocation of a plunger.

It needs to be noted that because of movement characteristics of a crosshead component, the crosshead box 1900 needs to have oil discharging and gas discharging functions. In the prior art, oil discharging and gas discharging are usually implemented by reserving an oil discharging and gas discharging hole in a box body of the crosshead box 1900 or in another manner. As a result, the crosshead box 1900 has a complex structure, and mechanical strength of the crosshead box 1900 is reduced. To resolve the foregoing problem, an avoidance groove 1340 is provided at a periphery of a side of the lever opening 1210 toward the crosshead box 1900 (in other words, on a surface of the crosshead box connecting plate opposite to the first surface above). When the crosshead component moves to a position closest to the crosshead box connecting plate 1200, with the presence of the avoidance groove 1340, the crosshead component does not contact the crosshead box connecting plate 1200 but has a gap from the crosshead box connecting plate 1200. The gap can ensure the oil discharging and gas discharging functions required by the crosshead box 1900.

Further, to avoid as much as possible that a lubricant is taken out of the crosshead box 1900 by the crosshead component, a sealing component (not shown in the figure) and a positioning groove (not shown in the figure) mounted fitting the sealing component are disposed on a side of the lever opening 1210 away from the crosshead box 1900.

As can be learned from above, in the present disclosure, the crosshead box 1900 and the fracturing pump spacer frame are connected by two sets of bolts. The first set of bolts is the long bolt 1920 that passes through the first bolt hole 1310 and is used for overall fastening and pretightening. The second set of bolts is the first bolt 1930 and the second bolt 1940 that respectively pass through the second bolt hole 1320 and the third bolt holes 1330 in the crosshead box connecting plate 1200, and is used for sealing and fastening between the crosshead box 1900 and fracturing pump spacer frame. Further, to better ensure a sealing effect, a sealing groove 1350 used for placing a sealing ring or a sealing loop or filling a sealant is from provided in a side of the crosshead box connecting plate 1200 close to the crosshead box 1900. The present disclosure is not limited thereto. The crosshead box connecting plate 1200 and the crosshead box 1900 may be directly bonded by a sealant, and the sealing groove 1350 is omitted.

It needs to be added that, to improve sealing reliability, a length of the sealing groove 1350 needs to be maximized. However, to make the entire first bolt hole 1310 have a uniform gas pressure, the sealing groove 1350 cannot completely surround the first bolt hole 1310. Therefore, the lever opening 1210 is located in an inner side of the sealing groove 1350. The second bolt hole 1320, the third bolt holes 1330, and the first bolt hole 1310 are located in an outer side of the sealing groove 1350, and the sealing groove 1350 is provided close to the first bolt hole 1310.

A formation manner of the sealing groove 1350 is not limited in the present disclosure. Apart from machining, another manner of removing a material may be used. In addition, it is to be noted that an arrangement position of the sealing groove 1350 needs to avoid a crankshaft box observation window and a crosshead box gas discharging cavity at the same time.

Through the foregoing structure, the present disclosure can avoid oil and gas leakage, to avoid adverse results caused by lubricant pollution, corrosion and wear of internal metal members, and the like caused by moisture. Compared with connection and sealing with one set of bolts, double fastening and connection of two sets of bolts can effectively ensure joining and fastening of sealing surfaces, avoid separation and slippage of sealing surfaces caused by a plunging force and a connecting rod lateral force, and block leakage of oil, gas, and oil pressure.

The support sleeve 1300 includes a cylindrical portion 1301 and a varying diameter portion 1302 that is located at each of two ends of the cylindrical portion 1301. That is, the varying diameter portion 1302 is disposed at each of connections between the support sleeve 1300 and the hydraulic end connecting plate 1100 and the crosshead box connecting plate 1200. A diameter of the varying diameter portion 1302 gradually increases in a direction away from a center of the support sleeve 1300. A specific shape of the varying diameter portion 1302 is not limited in the present disclosure. Preferably, the varying diameter portion 1302 has a frustum shape. In this case, a cross-section of the varying diameter portion 1302 is a trapezoid. Alternatively, the varying diameter portion 1302 has a flared shape.

Further, rounded corners are disposed at connections between the varying diameter portion 1302 and the cylindrical portion 1301, the hydraulic end connecting plate 1100, and the crosshead box connecting plate 1200.

In one aspect, molten iron throttles and accumulates when flowing through an abrupt corner at a high speed during pouring, and stress concentration tends to occur as the molten iron gradually cools. The arrangement of the varying diameter portion 1302 can implement a gradual transition of a corner, to increase punching efficiency of the molten iron, and avoid defects such as shrinkage and cold cracks of a cast due to structural accumulation and stress concentration of metal. In addition, erosion and damage of a sand mold corner caused by vortices and bubbles generated when the molten iron impacts the abrupt corner at a high speed can also be avoided. In another aspect, bending stress concentration and a deformation occur at a welding seam of a connection between a support sleeve and a side plate of a conventional welded spacer frame, and the welding seam is easily prone to cracking. Crossheads alternately enter a crosshead box, the reciprocation of the center of gravity makes a moment that the welding seam bears change cyclically, and as a result a deformation amount changes cyclically, which may cause vibration at this position. Under the action of a cyclic stress, expansion of a crack at a welding seam is further intensified. The varying diameter portion 1302 increases a diameter of a root portion of the support sleeve 1300, and increases flexural strength and support stiffness of the root portion of the support sleeve.

To enable the varying diameter portion 1302 to further facilitate a casting process while increasing the strength and stiffness of the support sleeve 1300, an aspect ratio of the varying diameter portion 1302 is 2:1 to 4:1. That is, a ratio of a length of the varying diameter portion 1302 in an axial direction of the support sleeve 1300 to a width (a difference between a radius of the varying diameter portion 1302 and a radius of the cylindrical portion 1301) of the varying diameter portion 1302 in a direction perpendicular to the axial direction of the support sleeve 1300 is 2:1 to 4:1. A size of the rounded corner preferably ranges from R15 to R20.

As can be learned from above, because of the convenience of plasticity in casting, a wall thickness of the support sleeve 1300 may change as a stress distribution changes. That is, the support sleeve 1300 is cast into a structure that is thick (has a large wall thickness) at two ends and is slightly thin (has a small wall thickness) in the middle. A diameter of the first bolt hole 1310 in the support sleeve 1300 needs to be kept consistent. This can effectively increase flexural strength of the root portion of the support sleeve 1300 and reduce an overall weight, and the shape further facilitates casting.

Arrangement positions and an arrangement quantity of the support sleeves 1300 are not limited in the present disclosure, and may be correspondingly set according to a quantity and positions of the first bolts 1930 of the crosshead box 1900. Preferably, two horizontal rows of support sleeves 1300 that are respectively located on an upper side and a lower side of the lever opening 1210 are disposed.

In addition, a bolt hole (not shown in the figure) used for mounting an integral oil receiving tray may be provided at a bottom of the support sleeve 1300, a bolt hole (not shown in the figure) used for mounting a fracturing pump cover plate or the like may be further provided in a side surface of the support sleeve 1300.

The fracturing pump spacer frame is used for connecting and supporting a crosshead box and a hydraulic end in a fracturing pump. During fracturing, the fracturing pump spacer frame needs to bear weights of the crosshead box and the hydraulic end in the vertical direction, and at the same time bears an axial force of the plunger in the horizontal direction. To avoid that two end plates of the fracturing pump spacer frame displace and sway relatively to affect a cylinder spacing to cause eccentric wear of the plunger, support stiffness of key force bearing points needs to be ensured.

However, in consideration of transportation costs and production costs of the fracturing pump, the weight of the fracturing pump needs to be decreased. For a fracturing pump spacer frame that only provides connection and support, a technician intends to decrease the weight of the fracturing pump spacer frame as much as possible.

In the present disclosure, a manner of a single-sided leg is used for the fracturing pump spacer frame. That is, the leg 1400 is disposed only below both the hydraulic end connecting plate 1100. It is proved through experiments and practice that for a fracturing pump with a small power below 4000 hp, the leg 1400 can achieve good support and vibration reduction effects, improve a load bearing status at a connection, and extend the service life of the fracturing pump spacer frame.

Specifically, the leg 1400 is approximately L-shaped, and includes a third vertical supporting plate 1410 that is vertically disposed and a second bottom supporting plate 1420 that is horizontally disposed. At least two legs 1400 are provided, and are uniformly distributed in a length direction of the hydraulic end connecting plate 1100. In this embodiment, two legs 1400 are provided, and are respectively located at two ends of the hydraulic end connecting plate 1100 in the length direction. A bottom plate fastening hole 1422 is provided in the second bottom supporting plate 1420. The fracturing pump spacer frame may be fastened at a predetermined position through the bottom plate fastening hole 1422.

Through a force bearing analysis of the fracturing pump spacer frame, a root portion of the support sleeve above the leg 1400 bears a largest moment (approximately 22 kN-m). Therefore, flexural strength of the structure at this position needs to be increased. In addition, because the root portion of the support sleeve above the leg 1400 is hindered by the third vertical supporting plate 1410 during bending, internal structures of the root portion press each other to cause stress concentration. Therefore, an additional first support rib plate 1411 is disposed at this position to reduce bending of the root portion, thereby inhibiting a bending deformation of the support sleeve and enhancing support stiffness.

Specifically, the first support rib plate 1411 is disposed at a connection between the third vertical supporting plate 1410 and the support sleeve 1300 located above the third vertical supporting plate 1410, a top of the first support rib plate 1411 is connected to the support sleeve 1300, and a side portion is connected to the third vertical supporting plate 1410 and the hydraulic end connecting plate 1100.

Preferably, a length of the first support rib plate 1411 away from the hydraulic end connecting plate 1100 is smaller than and equal to a length of the varying diameter portion 1302. This structure can connect the reinforcing rib plate to a position with strong flexural strength and support stiffness, to achieve a better reinforcing effect, thereby greatly increasing flexural strength of connecting points (moment weak points).

To ensure a relative position between the third vertical supporting plate 1410 and the second bottom supporting plate 1420, a second support rib plate 1421 is disposed at a connection between the third vertical supporting plate 1410 and the second bottom supporting plate 1420. A quantity of the second support rib plates 1421 is not limited in the present disclosure, and one or more second support rib plates may be provided. Preferably, for each leg 1400, two second support rib plates 1421 are provided, and are respectively located on two sides of each third vertical supporting plate 1410, thereby avoiding the bottom plate fastening hole 1422.

It needs to be noted that because an entire fracturing pump has a large fulcrum span, support stiffness at a single side foot can hardly resist flexural displacements at a middle-section crosshead box, a spacer frame, and a connection. Therefore, it needs to be allowed that the leg has a certain bending deformation, to avoid that when the leg is subjected to a moment, the reinforcing ribs press and shear each other to cause local damage caused by stress concentration.

Therefore, a gap zone is disposed between the first support rib plate 1411 and the second support rib plate 1421. A height of the gap zone is preferably larger than 5 mm, to allow a flexural deformation of the leg 1400. In other words, a vertical distance between a lowermost end of the first support rib plate 1411 and an uppermost end of the second support rib plate 1421 is preferably larger than 5 mm.

To avoid stress concentration and reduce a weight while ensuring strength, a thickness of each of the first support rib plate 1411 and the second support rib plate 1421 gradually decreases in a direction toward the gap zone. Further, the thickness of each of the first support rib plate 1411 and the second support rib plate 1421 along the length direction of the support sleeves gradually decreases in a direction towards the third vertical supporting plate 1410. Further, a rounded corner is disposed an edge of each of the first support rib plate 1411 and the second support rib plate 1421. The rounded corner can reduce stress concentration, and facilitate casting.

In summary, in the present disclosure, an integrally formed fracturing pump spacer frame is used, to avoid an impact of a welding defect on stiffness, strength, service life, and the like. An approximately U-shaped leg may support both a hydraulic end connecting plate and a crosshead box connecting plate, so that the number of support points is increased, a moment and a caused deformation are decreased, and service life is increased. For a single-side leg with a support rib plate, support stiffness is enhanced, and the leg is allowed to have a certain bending deformation. A varying diameter portion of a support sleeve increases flexural strength and support stiffness of a root portion of the support sleeve, and facilitates the implementation of a casting process.

What is claimed is:

1. A fracturing pump spacer frame, comprising:
- a hydraulic end connecting plate;
- a crosshead box connecting plate disposed spaced apart from and in parallel with the hydraulic end connecting plate; and
- at least one leg;
- wherein:
  - the hydraulic end connecting plate and the crosshead box connecting plate are fastened by support sleeves;
  - first bolt holes penetrating the hydraulic end connecting plate, the support sleeves, and the crosshead box connecting plate are further provided in the fracturing pump spacer frame;
  - the hydraulic end connecting plate, the crosshead box connecting plate, the support sleeves, and the at least one leg are integrally formed; and
  - each of the at least one leg comprises a first vertical supporting plate and a second vertical supporting plate that are vertically disposed and a first bottom supporting plate that is horizontally disposed, the first vertical supporting plate being located below the hydraulic end connecting plate, the second vertical supporting plate being located below the crosshead box connecting plate, and two sides of the first bottom supporting plate being respectively connected to lower ends of the first vertical supporting plate and the second vertical supporting plate.

2. The fracturing pump spacer frame according to claim 1, wherein:
- the at least one leg comprises at least two legs;
- the at least two legs are uniformly distributed in a length direction of the hydraulic end connecting plate; and each of the first vertical supporting plate and the second vertical supporting plate corresponding to each of the at least two legs comprises a first foot and a second foot, lower ends of the first foot and the second foot merging together.

3. The fracturing pump spacer frame according to claim 2, wherein the first foot is vertically disposed, the second foot is obliquely disposed, and an angle is formed between the first foot and the second foot.

4. The fracturing pump spacer frame according to claim 3, wherein upper ends of the first foot and the second foot are respectively located below different support sleeves.

5. The fracturing pump spacer frame according to claim 4, wherein a foot reinforcing rib is disposed in a middle of an inner side of each of the first foot and the second foot, and the foot reinforcing rib being along a length direction of each of the first foot and the second foot.

6. The fracturing pump spacer frame according to claim 5, wherein a rounded corner is disposed at an edge of the foot reinforcing rib.

7. The fracturing pump spacer frame according to claim 5, wherein a bottom plate reinforcing rib is disposed on the first bottom supporting plate parallel to an axial direction of the support sleeves, and two ends of the bottom plate reinforcing rib are respectively connected to the foot reinforcing rib on the first foot of the first vertical supporting plate and the first foot of the second vertical supporting plate.

8. The fracturing pump spacer frame according to claim 7, wherein a widening portion is disposed at an outer edge of each of the first foot and the second foot.

9. A fracturing pump spacer frame, comprising:

a hydraulic end connecting plate;

a crosshead box connecting plate disposed spaced apart from and in parallel with the hydraulic end connecting plate; and at least one leg;

wherein:

the hydraulic end connecting plate and the crosshead box connecting plate are fastened by support sleeves;

first bolt holes penetrating the hydraulic end connecting plate, the support sleeves, and the crosshead box connecting plate are further provided in the fracturing pump spacer frame;

the hydraulic end connecting plate, the crosshead box connecting plate, the support sleeves, and the at least one leg are integrally formed;

each of the at least one leg comprises a third vertical supporting plate that is vertically disposed and a second bottom supporting plate that is horizontally dispose;

a first support rib plate is disposed at a connection between the third vertical supporting plate and one of the support sleeve located above the third vertical supporting plate;

a second support rib plate is disposed at a connection between the third vertical supporting plate and the second bottom supporting plate; and a gap zone is formed between the first support rib plate and the second support rib plate.

10. The fracturing pump spacer frame according to claim 9, wherein a height of the gap zone is larger than 5 mm.

11. The fracturing pump spacer frame according to claim 9, wherein a thickness of each of the first support rib plate and the second support rib plate gradually decreases in a direction toward the gap zone, or, a thickness of each of the first support rib plate and the second support rib plate gradually decreases in a direction towards the third vertical supporting plate.

12. The fracturing pump spacer frame according to claim 1, wherein each of the support sleeves comprises a cylindrical portion and a tapered portion that is located at each of two ends of the cylindrical portion, and a diameter of the tapered portion gradually increases in a direction away from a center of the each of the support sleeves.

13. The fracturing pump spacer frame according to claim 12, wherein rounded corners are disposed at connections between the tapered portion and the cylindrical portion, between the tapered portion and the hydraulic end connecting plate, and between tapered portion and the crosshead box connecting plate.

14. The fracturing pump spacer frame according to claim 12, wherein a ratio of a length of the tapered portion in an axial direction of the support sleeves to a width of the tapered portion in a direction perpendicular to the axial direction of the support sleeves ranges from 2:1 to 4:1.

15. The fracturing pump spacer frame according to claim 1, wherein a hydraulic end opening is provided in a middle of the hydraulic end connecting plate, and a process hole is provided in a lower side of and as part of the hydraulic end opening.

16. The fracturing pump spacer frame according to claim 15, wherein a positioning pin opening is provided in each of two sides of the hydraulic end connecting plate in a length direction, and heights of the positioning pin openings located in the two sides of the hydraulic end connecting plate are different.

17. The fracturing pump spacer frame according to claim 1, wherein:

second bolt holes are provided in the crosshead box connecting plate paired with the first bolt holes; and two third bolt holes that are vertically arranged are provided in each of two sides of the crosshead box connecting plate in a length direction of the crosshead box connecting plate.

18. The fracturing pump spacer frame according to claim 17, wherein a concave recess is disposed at a periphery of each of the second bolt holes on a first surface of the crosshead box connecting plate facing the hydraulic end connecting plate.

19. The fracturing pump spacer frame according to claim 18, wherein a lever opening is provided in a middle of the crosshead box connecting plate, and an avoidance groove is provided at a periphery of the lever opening on a second surface of the crosshead box connecting plate opposite to the first surface.

20. The fracturing pump spacer frame according to claim 19, wherein a sealing groove is provided on the second surface of the crosshead box connecting plate, the lever opening being located in an inner side of the sealing groove, the second bolt holes, the third bolt holes, and the first bolt holes being located in an outer side of the sealing groove, and portions of the sealing groove being close to the first bolt holes.

* * * * *